United States Patent [19]

Bitzer et al.

[11] 4,016,013

[45] Apr. 5, 1977

[54] PROCESS FOR PRODUCING DIFFUSION LAYERS OF CARBIDES, NITRIDES AND/OR CARBONITRIDES

[75] Inventors: Diethelm Bitzer, Putzbrunn near Munich, Germany; Dieter Lohmann, Muttenz, Switzerland

[73] Assignee: Ciba-Geigy Corporation, Ardsley, N.Y.

[22] Filed: Feb. 5, 1975

[21] Appl. No.: 547,285

[30] Foreign Application Priority Data

Feb. 7, 1974 Switzerland ..... 1702/74

[52] U.S. Cl. ..... 148/16.5; 148/16.6; 148/20.3; 427/249

[51] Int. Cl.[2] ..... C21D 1/48

[58] Field of Search ..... 148/16.5, 16.6, 20.3, 148/26, 27, 28, 6.11, 6.3; 427/248, 249; 260/249.8; 423/371, 382, 440

[56] References Cited

UNITED STATES PATENTS

| | | | |
|---|---|---|---|
| 1,929,252 | 10/1933 | Morris | 148/16.6 |
| 2,562,065 | 7/1951 | Sawyer et al. | 148/27 |
| 3,637,320 | 1/1972 | Wakefield et al. | 415/200 |
| 3,682,789 | 8/1972 | Beutler et al. | 427/249 |
| 3,771,976 | 11/1973 | Wakefield | 427/249 |
| 3,783,007 | 1/1974 | Bloom et al. | 148/16.6 |
| 3,901,678 | 8/1975 | Fischer | 71/74 |

FOREIGN PATENTS OR APPLICATIONS

| | | | |
|---|---|---|---|
| 345,642 | 8/1904 | France | 148/27 |
| 2,180,463 | 1/1974 | France | 427/249 |
| 1,307,018 | 2/1973 | United Kingdom | 427/249 |
| 1,251,054 | 10/1971 | United Kingdom | 427/249 |

OTHER PUBLICATIONS

Caillet et al.; C.R. Acad. Sc. Paris, 270, p. 1867, June 1970.

Karrer, P; Organic Chemistry, New York, 1938, pp. 210–212, 748–749, and 762–764.

*Primary Examiner*—Walter R. Satterfield
*Attorney, Agent, or Firm*—Luther A. R. Hall

[57] ABSTRACT

A process for producing diffusion layers of carbides, nitrides and/or carbonitrides on metallic or metalloid substrates, using certain triazines and pyrimidines as sources of carbon and nitrogen, is described. Uniform and well-adhering diffusion layers can be produced in short reaction times by means of this process.

9 Claims, No Drawings

PROCESS FOR PRODUCING DIFFUSION LAYERS OF CARBIDES, NITRIDES AND/OR CARBONITRIDES

The present invention relates to a process for producing diffusion layers of carbides, nitrides and/or carbonitrides of iron, boron or silicon and/or the transition metals of sub-groups 4–6 of the periodic table on metallic or metalloid substrates and to the substrates coated in accordance with this process.

It has been found that diffusion layers of carbides, nitrides and/or carbonitrides of iron, boron or silicon and/or of the transition metals of sub-groups 4–6 of the periodic table can be produced in a simple manner on metallic or metalloid substrates which consist at least partially of iron, boron or silicon and/or of transition metals of sub-groups 4–6 of the periodic table, by direct thermal reaction of such substrates with substances which act as sources of carbon and nitrogen, optionally in the presence of further additives, by using, as sources of carbon and nitrogen, at least one compound of the formula I

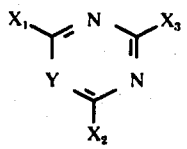

(I)

wherein Y represents

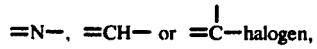

one of $X_1$, $X_2$ and $X_3$ represents hydrogen, halogen, alkyl, phenyl, —CN,

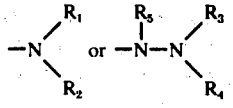

and the other two independently of one another represent halogen,

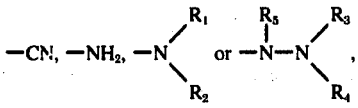

$R_1$, $R_3$ and $R_4$ independently of one another denote hydrogen, alkyl, halogenoalkyl, cyanoalkyl, aminoalkyl, alkylaminoalkyl or alkenyl, $R_2$ denotes alkyl, halogenoalkyl, cyanoalkyl, aminoalkyl, alkylaminoalkyl or alkenyl and $R_5$ denotes hydrogen or alkyl, and alkyl groups contain 1–4 carbon atoms, the alkyl parts in substituted alkyl groups contain 2–4 carbon atoms each and alkenyl groups contain 3 or 4 carbon atoms each.

Compared to known methods, the process according to the invention is distinguished, above all, by its simplicity and economy, in that the elements carbon and nitrogen, required to form the carbides, nitrides and/or carbonitrides, and optionally other elements which influence the course of the reaction, such as hydrogen, can be fed to the reaction zone in a simple manner and in the desired ratios. Furthermore, uniform, compact and well-adhering diffusion layers which are free from pores and cracks can be achieved in accordance with the process of the invention even at relatively low reaction temperatures and with short reaction times. A further advantage is that the process can in general be carried out at normal pressure or slightly reduced or slightly elevated pressure (approx. 700–800 mm Hg), which in many cases permits simplification of the apparatuses required to carry out the reaction.

The compounds of the formula I provide carbon and nitrogen, and where relevant hydrogen and/or halogen, in a reactive state, under the reaction conditions.

Alkyl or alkenyl groups represented by $X_1$, $X_2$ or $X_3$, or $R_1$, $R_2$, $R_3$, $R_4$ or $R_5$, can be straight-chain or branched. Halogen denotes fluorine, bromine or iodine, but especially chlorine.

Examples of alkyl groups $X_1$, $X_2$ or $X_3$ according to the definition are the methyl, ethyl, n-propyl, isopropyl, n-butyl, sec.-butyl and tert.-butyl group. The following are examples of groups

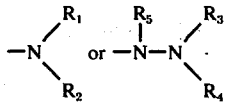

represented by $X_1$, $X_2$ or $X_3$:

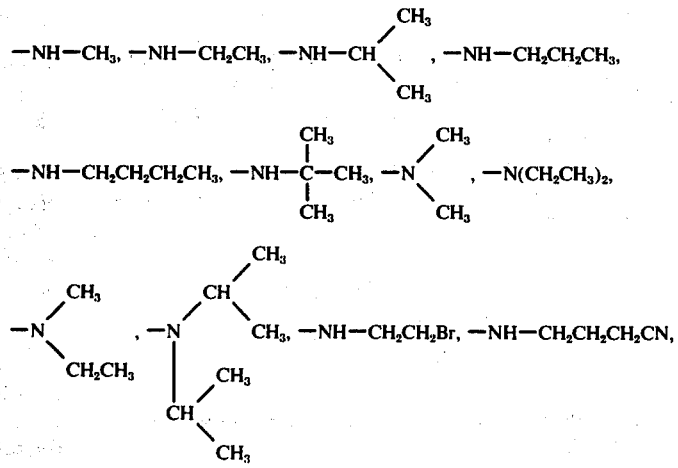

-continued

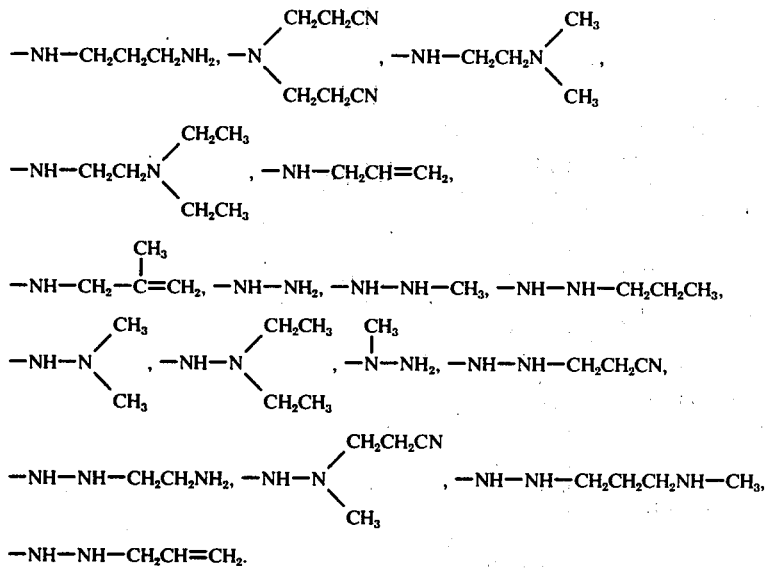

Preferred compounds of the formula I are those wherein Y represents

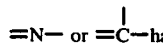

one of $X_1$, $X_2$ and $X_3$ represents halogen,

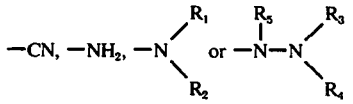

and the other two independently of one another represent halogen,

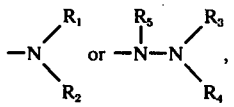

wherein $R_1$, $R_3$, $R_4$ and $R_5$ independently of one another denote hydrogen or alkyl with 1–4 carbon atoms and $R_2$denotes alkyl with 1–4 carbon atoms or alkenyl with 3 or 4 carbon atoms.

Particularly preferred compounds are those of the formula I wherein Y represents =N—, one of $X_1$, $X_2$ and $X_3$ represents

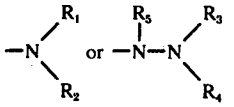

and the other two independently of one another represent chlorine,

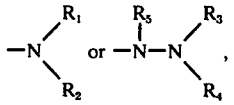

and those of the formula I wherein Y represents =N— and $X_1$, $X_2$ and $X_3$ independently of one another represent

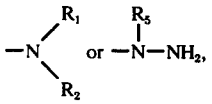

and $R_1$ and $R_5$ denote hydrogen or alkyl with 1–4 carbon atoms, $R_2$ denotes alkyl with 1–4 carbon atoms or alkenyl with 3 or 4 carbon atoms and $R_3$ and $R_4$ denote alkyl with 1–4 carbon atoms.

The compounds of the formula I are known or can be manufactured in a known manner. The following may be mentioned as specific compounds of the formula I: 2,4,5,6-tetrachloropyrimidine, 2,4,6-tribromopyrimidine or 2,4,6-trichloropyrimidine, 2,4-dichloropyrimidine, 2,4,-dichloro-6-methylpyrimidine, 2,4-dichloro-6-isopropyl-pyrimidine or 2,4-dichloro-6-phenyl-pyrimidine, 2,4-dibromo-6-cyanopyrimidine, 2-chloro-4n-butyl-6-methylamino-pyrimidine, 2-chloro-4,6-diethylaminopyrimidine, 2-chloro-4,6-bis-(dimethylamino)-pyrimidine, 2,4,6-tris-methylamino-pyrimidine, 2,6-bis-(dimethylamino)-5-cyanopyrimidine, 2-propyl-4,6-di-isopropylamino-pyrimidine, 2-chloro-4,6-bis-(β-cyanoethylamino)-pyrimidine, 2-chloro-4,6-bis-(β-bromoethylamino)-pyrimidine, 2,4-dichloro-6-(β-dimethylaminoethylamino)-pyrimidine, 2-chloro-4,6-diallylamino-pyrimidine, 2-chloro-4,6-dihydrazino-pyrimidine, 2-bromo-4-ethyl-6-ethylhydrazino-pyrimidine, 2,4,6-trichloro-s-triazine or 2,4,6-tribromo-s-triazine, 2,4-dichloro-6-n-butyl-s-triazine, 2,4-dichloro-6-phenyl-s-triazine, 2-chloro-4,6-diethylamino-s-triazine, 2,4-dichloro-6-methylamino-s-triazine, 2,4-dichloro-6-diethylamino-s-triazine and 2,4-dichloro-6-diisopropylamino-s-triazine, 2-chloro-4,6-di-methylamino-s-triazine, 2-chloro-4,6-di-n-butylamino-s-triazine, 2-chloro-4,6-bis-(diethylamino)-s-triazine and 2-chloro-4,6-bis-(diisopropylamino)-s-triazine, 2,6-dichloro-4-(β-cyanoethylamino)-s-triazine, 2-chloro-4-isopropylamino-6-allylamino-s-triazine, 2,4-diamino-6-methallylamino-s-triazine, 2,4-diamino-6-cyano-s-triazine, 2-chloro-4,6-bis-(β-bromoethylamino)-s-triazine, 2,4-dichloro-6-ethylaminomethylamino-s-triazine, 2-dipropylamino-4,6-dihydrazino-s-triazine, 2,4-di-isopropylamino-6-methylhydrazino-s-triazine, 2,4-bis-(dimethylamino)-6-[N,N-bis-(aminoethyl)]-hydrazino-s-triazine, 2,4,6-tris-(diethylamino)-s-triazine, 2,4-bis-(diethylamino)-6-dimethylamino-s-triazine, 2,4-bis-(diethylamino)-6-isopropylamino-s-triazine, 2,4-bis-(dimethylamino)-6-n-butylamino-s-triazine and 2,4-bis-(dimethylamino)-6-(1-methylhydrazino)-s-triazine.

The substrates which can be employed in the process according to the invention can consist wholly or partially of iron, boron or silicon and/or transition metals of sub-groups 4–6 of the periodic table, such as titanium, vanadium, niobium, tantalum, chromium, molybdenum tungsten, zirconium, hafnium and uranium.

Preferred substrates are those which consist at least partially of iron and/or transition metals as defined above, especially uranium, tantalum, vanadium or tungsten, but very particularly substrates containing iron and, above all, titanium, such as cast iron, steel, titanium and titanium alloys, for example titanium-aluminium-vanadium alloys.

The substrates can be employed in any desired form, for example as powders, fibres, filaments, foils, machined articles or components of very diverse types.

Before the reaction, the substrates can, if appropriate, be pretreated in the customary manner, for example with known solvents and/or etching agents, such as methyl ethyl ketone, trichloroethylene or carbon tetrachloride, or aqueous nitric acid, to remove interfering deposits, such as oxides, from the surface of the substrate and give improved diffusion.

Depending on the end use and/or on the nature of the compound of the formula I it can be desirable to carry out the reaction in the presence of further additives, such as hydrogen, atomic or molecular nitrogen or further compounds which act as sources of nitrogen and/or carbon under the reaction conditions. These substances or compounds can contribute to the formation of the carbides, nitrides or carbonitrides or shift the equilibrium of the formation reaction more towards the nitrides or the carbides. Examples of such additional compounds which act as sources of nitrogen and/or carbon under the reaction conditions are methane, ethane, n-butane, N-methylamine, N,N-diethylamine, ethylenediamine, benzene and ammonia.

The production, according to the invention, of diffusion layers of carbides, nitrides and/or carbonitrides can be carried out, within the scope of the definition, in accordance with any desired methods which are in themselves known.

The preferred process is to react the compounds of the formula I and any additives, in the gas phase, with the substrate which forms the other reactant, in a so-called CVD reactor (CVD = Chemical Vapour Deposition). The reaction can be carried out with application of heat or radiant energy. The reaction temperatures or substrate temperatures are in general between about 500° and 1,800° C, preferably between 800° and 1,400° C.

Hydrogen is optionally used as the reducing agent. In general it is advantageous to use a carrier gas, such as argon, to transport the starting materials into the reaction zone.

The diffusion layers can also be produced by reaction of the reactants, that is to say of a compound of the formula I and any additives, with the substrate according to the definition in a plasma, for example by so-called plasma spraying. The plasma can be produced in any desired manner, for example by means of an electric arc, glow discharge or corona discharge. The plasma gases used are preferably argon or hydrogen.

Finally, the diffusion layers can also be produced in accordance with the flame spraying process, wherein hydrogen/oxygen or acetylene/oxygen flames are generally used.

Depending on the choice of the compounds of the formula I, of the additives, of the reaction temperatures and/or of the substrates, carbides, nitrides, carbonitrides or mixtures thereof are formed in accordance with the process of the invention.

Examples of fields of application of the process according to the invention are the surface improvement or surface hardening of metals according to the definition in order to improve the wear resistance and corrosion resistance, for example in the case of tool steel, cast iron, titanium, metal substrates containing titanium, sheet tantalum, sheet vanadium and sheet iron, for example for use in lathe tools, press tools, punches, cutting tools and drawing dies, engine components, precision components for watches and textile machinery, rocket jets, corrosion-resistant apparatuses for the chemical industry, and the like, the surface treatment of electronic components, for example to increase the so-called "work function", and the treatment of boron, silicon and tungsten fibres or filaments to achieve better wettability by the metal matrix, and to protect the fibres.

EXAMPLE 1

The experiments are carried out in a vertical CVD reactor of Pyrex glass which is closed at the top and bottom by means of a flange lid. The reaction gases are passed into the reactor through a spray to achieve a uniform stream of gas. The temperature on the substrate is measured by means of a pyrometer. The compounds of the formula I are vaporised in a vaporiser inside or outside the reactor.

The substance can be heated by resistance heating, high frequency heating or inductive heating or in a reactor externally heated by means of a furnace.

A titanium rod of 1 mm diameter is heated to 950° C by resistance heating in an argon atmosphere in an apparatus of the type described above. At this temperature, a gas mixture consisting of 97% by volume of argon and 3% by volume of cyanuric chloride is passed over the substrate for 2 hours, the total gas flow being 0.2 liter/minute [l/min] and the internal pressure in the reactor being 720 mm Hg. After this period, a smooth, very hard diffusion layer (layer thickness 50–60 μm), which is free from pores and cracks, has formed on the surface of the titanium rod. Whilst the substrate has a Vickers micro-hardness of $HV_{0.05}$ = approx. 230 kg/mm², the micro-hardness of the diffusion layer is $HV_{0.05}$ = approx. 870 kg/mm².

EXAMPLES 2–17

The table which follows lists further substrates which were treated in accordance with the procedure described above:

| Ex. No. | Reactor heating | Temp. °C. | Pressure mm. Hg. | Reaction time mins. | Gas mixture (in % by vol.) | Total gas flow l./min. | Product: Substrate/colour (in % by weight) | Product: Layer thickness μm/appearance of layer | Product: Micro-hardness kg./mm.² |
|---|---|---|---|---|---|---|---|---|---|
| 2 | resistance heating | 950 | 720 | 120 | 97% argon 3% 2,4-dichloro-6-diisopropylamino-s-triazine | 0.2 | titanium rod, ϕ 1 mm grey | 50–60 μm | substrate $HV_{0.05}$ = 270 layer $HV_{0.05}$ = 1,000 |
| 3 | " | 950 | 720 | 120 | 97% argon 3% 2-chloro-4,6-bis-(diethylamino)-s-triazine | 0.2 | " | 100 μm | substrate $HV_{0.05}$ = 300 layer $HV_{0.05}$ = 930 |
| 4 | " | 950 | 720 | 120 | 97% argon 3% 2,4-bis-(diethylamino)-6-dimethylamino-s-triazine | 0.2 | " | 100 μm | substrate $HV_{0.05}$ = 300 layer $HV_{0.05}$ = 1,250 |
| 5 | " | 950 | 720 | 120 | 97% argon 3% 2,4,5,6-tetrachloropyrimidine | 0.2 | titanium rod, ϕ 2 mm grey | 50–60 μm homogeneous, pore and crack free | substrate $HV_{0.05}$ = 270 layer $HV_{0.05}$ = 670 |
| 6 | " | 1,400 | 720 | 120 | 97% argon 3% 2,4,6-tris-(diethylamino)-s-triazine | 0.2 | titanium rod, ϕ 1 mm grey | approx. 120 μm homogeneous layer, pore and crack free | substrate $HV_{0.05}$ = 270 layer $HV_{0.05}$ = 1,790 |
| 7 | externally heated by a furnace | 950 | 720 | 240 | 98% argon 2% 2,4-bis-(dimethylamino)-6-(1-methylhydrazino)-s-triazine | 0.2 | titanium wire, ϕ 1 mm grey, matt | 40–80 μm homogeneous, good adhesion* | substrate $HV_{0.05}$ = 280 layer $HV_{0.05}$ = 610 |
| 8 | " | 950 | 720 | 240 | 98% argon 2% 2,4-bis-(dimethylamino)-6-(1-methylhydrazino)-s-triazine | 0.2 | "Titanium 230" (max. 0.2% Fe, 2–3% Cu), matt grey | 40–80 μm homogeneous, good adhesion | substrate $HV_{0.05}$ = 293 layer $HV_{0.05}$ = 713 |
| 9 | " | 950 | 720 | 240 | " | 0.2 | boron grey-black | 2–4 μm good adhesion, slightly porous | substrate $HV_{0.05}$ = 4,020 layer $HV_{0.05}$ = 3,710 |
| 10 | " | 950 | 720 | 240 | 98% argon 2% 2,6-bis-(dimethylamino)-5-cyanopyrimidine | 0.3 | titanium wire, ϕ 1 mm dark grey, matt | 110–110 μm* good adhesion, homogeneous | substrate $HV_{0.05}$ = 270 layer $HV_{0.05}$ = 701 |
| 11 | " | 950 | 720 | 240 | " | 0.2 | "Titanium 230" matt grey | 16–20 μm good adhesion, homogeneous | substrate $HV_{0.05}$ = 300 layer $HV_{0.05}$ = 1,450 |
| 12 | " | 950 | 720 | 240 | 97% argon 3% 2,4-dichloro-6-(diallylamino)-s-triazine | 0.2 | titanium wire, ϕ 1 mm grey-yellow | approx. 30 μm good adhesion, slightly porous | substrate $HV_{0.05}$ = 270 layer $HV_{0.05}$ = 530 |
| 13 | " | 950 | 720 | 240 | 97% argon 3% 2,4-dichloro-6-(diallylamino)-s-triazine | 0.2 | "TiAl6V4" titanium alloy (6% Al, 4% V), grey-yellow, matt | 32–38 μm good adhesion, slightly porous | substrate $HV_{0.05}$ = 340 layer $HV_{0.05}$ = 516 |
| 14 | " | 800 | 720 | 480 | 97% argon 3% 2,4,6-tris-(diethylamino)-s-triazine | 0.2 | titanium wire, ϕ 1 mm matt grey | 10–30 μm good adhesion, homogeneous | substrate $HV_{0.05}$ = 180 layer $HV_{0.05}$ = 380 |

| Ex. No. | Reactor heating | Temp. °C. | Pressure mm. Hg. | Reaction time mins. | Gas mixture (in % by vol.) | Total gas flow l./min. | Product: Substrate/colour (in % by weight) | Product: Layer thickness μm/appearance of layer | Product: Micro-hardness kg./mm.² |
|---|---|---|---|---|---|---|---|---|---|
| 15 | externally heated by a furnace | 800 | 720 | 480 | 97% argon 3% 2,4,6-tris-(diethylamino)-s-triazine | 0.2 | small sheets of "TiAl6V4" Ti-Al alloy, matt grey | 10-30 μm good adhesion, homogeneous | substrate $HV_{0.05}$ = 340 layer $HV_{0.05}$ = 510 |
| 16 | " | 800 | 720 | 480 | " | 0.2 | molybdenum wire, ϕ 0.6 mm grey | approx. 40 μm good adhesion, homogeneous | substrate $HV_{0.05}$ = 280 layer $HV_{0.05}$ = 521 |
| 17 | " | 1,400 | 720 | 120 | 97% argon 3% 2,4-bsi-(dimethylamino)-6-(1-methylhydrazino)-s-triazine | 0.2 | niobium wire, ϕ 0.5 mm grey | approx. 50 μm pore free, good adhesion | substrate $HV_{0.05}$ = 195 layer $HV_{0.05}$ = 1,700 |

* Lattice constant $a$ = 4.27 Å → titanium carbonitride

EXAMPLE 18

The experiment is carried out in a plasma reactor with a plasma torch of conventional construction [Model PJ 139 H of Messrs. Arcos, Brussels; torch rating: 7.8 kW (30 V, 260 A)]. The reactor is located in a water-cooled reaction chamber of stainless steel, which is sealed from the outside atmosphere. The plasma is produced by a DC arc between the tungsten cathode and the copper anode of the plasma torch. The cathode and anode are also water-cooled. Argon or hydrogen can be used as plasma gases. The reaction gases are introduced into the plasma beam with the aid of carrier gas, through lateral bores in the outlet jet of the copper anode. The concentration of the reaction gases in the stream of carrier gas is set by means of thermostatically controllable vapouriser devices and flow regulators. The substrate, which can under certain circumstances be water-cooled, is located at a distance of 1–5 cm from the outlet orifice of the plasma beam in the copper anode.

At the beginning of the experiment the reaction chamber is evacuated, flushed and filled with argon. The plasma gas (argon, 90mols/hour) is then introduced and the plasma torch is lit. A nitriding steel ("Böhler ACE", DIN designation 34 CrAlMo 5; 0.34% by weight C, 1.2% by weight Cr, 0.2% by weight Mo, 1.0% by weight Al, from Messrs. Gebr. Böhler & Co., Dusseldorf, West Germany) is located at a distance of 2 cm from the outlet orifice of the plasma beam, and the reaction gas and the carrier gas are then introduced into the plasma beam at the following rates: carrier gas (argon): 4 mols/hour, 2,4,6-tris-(diethylamino)-s-triazine: 0.005 mol/hour. The temperature of the plasma flame is above 3,000° C; the temperature of the substrate surface is approx. 1,200° C. After a reaction time of 4 hours, the plasma torch is switched off and the treated substrate is cooled in the gas-filled reaction chamber. An 0.1 mm thick layer has formed on the surface of the nitriding steel; Vickers micro-hardness $HV_{0.05}$: substrate 220–290 kg/cm²; layer 1,150–1,280 kg/mm².

EXAMPLE 19

To produce diffusion layers in a $C_2H_2/0_2$ flame, an acetylene/oxygen welding torch of conventional construction (Model No. 7 of Messrs. Gloor, Dubendorf, Switzerland) is used. The welding torch is water-cooled. Acetylene and oxygen are premixed in the torch chamber and ignited at the orifice of the torch. The flame is within a metal tube, connected to the torch and provided with lateral bores for introducing the reaction gases. The torch is surrounded by a water-cooled reaction chamber of stainless steel. The reaction gases are introduced into the flame with the aid of a carrier gas. The concentration of the reaction gases is adjusted by means of thermostatically controllable vapouriser devices and flow regulators. The substrate to be treated is located at a distance of 1–3 cm from the torch orifice and is water-cooled if appropriate.

At the beginning of the experiment, the $C_2H_2/O_2$ flame is ignited and regulated so that a slight excess of $C_2H_2$ is present without soot being formed. Oxygen supply: 21 mols/hour, acetylene supply: approx. 21.5 mols/hour. Thereafter, 2,4,6-tris-(diethylamino)-s-triazine (0.15 mol/hour) together with the carrier gas (hydrogen, 8 mols/hour) is introduced into the flame. A substrate of non-alloyed steel (0.1% by weight C) is located at a distance of 2.5 cm from the torch orifice and is water-cooled so that the temperature of the substrate surface is about 850° C. The temperature of the flame is 3,000° C. After a reaction time of 12.5 minutes the burner is switched off and the treated substrate is cooled in the reaction chamber. A hard diffusion later, 60 μm thick, has formed on the surface of the steel; Vickers micro-hardness $HV_{0.05}$ = 1,100–1,200 kg/mm².

We claim:

1. A process for producing on a metallic or metalloid substrate, which consists at least partially of one or more of the elements selected from the group consisting of iron, boron, silicon and the transition metals of sub-groups 4 to 6 of the periodic table, a diffusion layer of material selected from the group consisting of said metal carbide, nitride and carbonitride which comprises heating said substrate to a temperature of 500° C. to 1800° C., and contacting said substrate with a gaseous or vaporous reactant stream comprising a carrier gas selected from argon and hydrogen and at least one carbon — and nitrogen — releasing compound which readily decomposes at substrate temperature, said compound selected from the group consisting of cyanuric chloride, 2,4-dichloro-6-diisopropylamino-s-triazine, 2-chloro-4,6-bis(diethylamino)-s-triazine, 2,4-bis(diethylamino)-6-dimethylamino-s-triazine, 2,4,5,6-tetrachloropyrimidine, 2,4,6-tris(diethylamino)-s-triazine, 2,4-bis(dimethylamino)-6(1-methylhydrazino)-s-triazine, 2,6-bis(dimethylamino)-5-(cyanopyrimidine and 2,4-dichloro-6-(diallylamino)-s-triazine, permitting reaction thereof to form said diffusion layer on said substrate.

2. A process according to claim 1 wherein said substrate is heated to a temperature of 800° C. to 1400° C.

3. A process according to claim 1 wherein the reaction pressure is from 700 to 800 mm Hg.

4. A process according to claim 1 wherein said carbon- and nitrogen- releasing compound is present in the gaseous reactant stream at a concentration of up to 3% by volume.

5. A process as claimed in claim 1 using 2,4,6-tris-(diethylamino)-s-triazine as the compound of formula I.

6. A process as claimed in claim 1 using 2-chloro-4,6-bis-(diethylamino)-s-triazine as the compound of formula I.

7. A process as claimed in claim 1 using 2,4-bis-(dimethylamino)-6-(1-methylhydrazino)-s-triazine as the compound of formula I.

8. A process as claimed in claim 1 using 2,4-dichloro-6-(diallylamino)-s-triazine as the compound of formula I.

9. A process as claimed in claim 1 using 2-dimethylamino-4,6-bis-(diethylamino)-s-triazine as the compound of formula I.

* * * * *